US008310400B2

(12) United States Patent
Wang

(10) Patent No.: US 8,310,400 B2
(45) Date of Patent: Nov. 13, 2012

(54) MOBILE APPARATUS

(75) Inventor: Ching-Sung Wang, Taoyuan County (TW)

(73) Assignee: HTC Corporation, Taoyuan County (TW)

( * ) Notice: Subject to any disclaimer, the term of this patent is extended or adjusted under 35 U.S.C. 154(b) by 430 days.

(21) Appl. No.: 12/619,657

(22) Filed: Nov. 16, 2009

(65) Prior Publication Data

US 2010/0245180 A1 Sep. 30, 2010

(30) Foreign Application Priority Data

Mar. 26, 2009 (TW) ..... 98109994 A

(51) Int. Cl.
*H01Q 1/24* (2006.01)

(52) U.S. Cl. ..... 343/702; 343/829; 343/846

(58) Field of Classification Search ..... None
See application file for complete search history.

(56) References Cited

U.S. PATENT DOCUMENTS 4,827,266 A 5/1989 Sato et al.
7,439,916 B2 * 10/2008 Wang et al. ..... 343/700 MS
2002/0075192 A1 * 6/2002 Iwai et al. ..... 343/702
2005/0140554 A1 * 6/2005 Wang et al. ..... 343/702
2007/0120748 A1 * 5/2007 Jenwatanavet et al. ..... 343/702
2010/0259456 A1 * 10/2010 Desclos et al. ..... 343/730

FOREIGN PATENT DOCUMENTS

EP 1209759 5/2002
EP 2099093 9/2009
WO 2007095371 8/2007

OTHER PUBLICATIONS

"Search Report of European Counterpart Application" issued on Apr. 7, 2010, p. 1-p. 4.
"Office Action of European Counterpart Application" issued on Apr. 16, 2010, p. 1-p. 4.

* cited by examiner

*Primary Examiner* — Trinh Dinh
(74) *Attorney, Agent, or Firm* — Jianq Chyun IP Office

(57) ABSTRACT

A mobile apparatus is provided. The mobile apparatus includes an antenna and a ground plane. The antenna is used to receive or transmit a radio frequency signal and includes a grounding part having a first ground terminal and a second ground terminal. Wherein, a distance between the first ground terminal and the second ground terminal is associated with a wavelength of the radio frequency signal. The ground plane is electrically connected to the grounding part of the antenna through the first ground terminal and the second ground terminal. The present invention effectively reduces a specific absorption ratio and a required height for setting the antenna such that a bandwidth of the antenna is increased.

13 Claims, 8 Drawing Sheets

MOBILE APPARATUS

CROSS-REFERENCE TO RELATED APPLICATION

This application claims the priority benefit of Taiwan application serial No. 98109994, filed on Mar. 26, 2009. The entirety of the above-mentioned patent application is hereby incorporated by reference herein and made a part of this specification.

BACKGROUND OF THE INVENTION

1. Field of the Invention

The present invention relates to a mobile apparatus, and particularly to a mobile apparatus with an antenna of a grounding part having double ground terminals.

2. Description of Related Art

Currently, communication methods of the public are gradually changed to wireless communications, and wireless communication devices become more diversified, for example, smart phones, multimedia players, personal digital assistants (PDA), satellite navigation devices and so on. Owing to current handheld 3 G communication devices, for example, mobile phones, designed in a way towards a trend of light weight, slimness, tiny and compact size, antenna design on the other hand also requires improvements and updates different from traditional ways of the antenna design.

Currently, there are two general and common ways of the antenna design for wireless communication devices in the market. One is a planar inverted F antenna (PIFA) as illustrated in FIG. 1A and FIG. 1B, and the other is a monopole antenna as illustrated in FIG. 2A and FIG. 2B. Referring to FIG. 1A and FIG. 1B, the PIFA 100 includes, in addition to a body part 100, also a feeding part 120 and a grounding part 130, wherein the grounding part 130 requires to be electrically connected to a ground plane, and the design of the PIFA 100 mainly acquires a plurality of required resonance frequencies through two current paths with different lengths. On the other and, referring to FIG. 2A and FIG. 2B, the design of a monopole antenna 210 requires a clearance area 220 on surroundings of the monopole antenna 210 in order to prevent electronic components too close to the monopole antenna 210 from interfering to antenna performance.

It is to be noted that, conventional PIFAs mainly have advantages of easy design for miniaturization, and a specific absorption ratio (SAR) is smaller for use of the antenna of the mobile apparatus. However, if the PIFA is disposed internally inside the mobile apparatus, a height of the antenna is limited due to adaptation of the design for miniaturization, also meaning a limitation of a spacing distance between the body part and the ground plane such that the PIFA has disadvantages of smaller bandwidth and lower antenna gain. Therefore, for the PIFA, a tradeoff of the height and the bandwidth of the antenna is a major challenge in the design for the antenna.

SUMMARY OF THE INVENTION

The present invention provides a mobile apparatus which utilizes a structural design of a grounding part of double ground terminals to increase a bandwidth of an antenna and to reduce a required height for setting the antenna in addition to effectively reduce a specific absorption ratio (SAP) and a phantom effect.

The present invention provides a mobile apparatus which includes an antenna and a ground plane. The antenna is used to receive or transmit a radio frequency (RF) signal and includes a grounding part having a first ground terminal and a second ground terminal The ground plane is electrically connected to the grounding part of the antenna through the first ground terminal and the second ground terminal A distance between the first ground terminal and the second ground terminal is associated with a wavelength of the RF signal herein.

In one embodiment of the present invention, the distance with respect to the wavelength is between 1/64 times and 1/4 times. In one embodiment of the present invention, the grounding part includes a conductive element, the conductive element extending inward from the second ground terminal of the grounding part so as to make a body part and the conductive element at least overlapped partially on a vertical plane of projection, and the first ground terminal is disposed at the other terminal of the conductive element and the conductive element is electrically connected to the ground plane, wherein the conductive element is used to increase an impedance match of the main body of the antenna in the mobile apparatus. Wherein, the conductive element, in addition to extending from the second ground terminal of the grounding part, may also be integrated with the antenna.

In one embodiment of the present invention, the antenna also includes a feeding part and a body part. Wherein, the feeding part is electrically connected to a transceiver circuit. The body part is electrically connected to the grounding part and the feeding part, and the body part is used to receive or transmit the RF signal.

In one embodiment of the present invention, the mobile apparatus also includes a first elastic element and a second elastic element. The first elastic element is corresponding to the first ground terminal and suitable for electrically connecting to the grounding part herein. The second elastic element is corresponding to the feeding part and suitable for electrically connecting to the feeding part.

In one embodiment of the present invention, a first substrate, a first housing, a second housing, and a coaxial cable are also included. Wherein, the first housing and the second housing are used to form a first chamber, the grounding part extends from an external surface of the first housing to an internal surface of the first housing, such that the first ground terminal and the second ground terminal are disposed on the internal surface of the first housing. The first substrate is disposed in the first chamber and fixed on the second chamber. To be specific, the ground plane is disposed on the second housing, and the first elastic element and the second elastic element are assembled on the first substrate. The coaxial cable is disposed in the first chamber and electrically connected to the first substrate and the ground plane.

In one embodiment of the present invention, the feeding part passes through the first housing for extending to the internal surface of the first housing, and the body part is fixed on the external surface of the first housing so as to make the antenna cover on a surface of the first housing.

In one embodiment of the present invention, the mobile apparatus also includes a third housing, a fourth housing, a second substrate, a third substrate, a conductive gasket, and the coaxial cable. The third housing and the fourth housing are used to form a second chamber, wherein the antenna covers on a surface of the third housing. The second substrate is disposed in the second chamber and fixed on the fourth housing. Besides, the ground plane is disposed on the fourth housing, and the second housing is electrically connected to the ground plane. The third substrate is disposed in the second chamber, wherein the conductive gasket is disposed at a neighboring location of a corner of the third substrate, but there is a spacing between the third substrate and the conductive gasket such that the third substrate and the conductive gasket are not in contact, and the second ground terminal is electrically connected to the ground plane via the conductive gasket, wherein the first elastic element and the second elastic element are assembled on the third substrate, and a portion of a projection plane of the third substrate partially covers the conductive gasket. The coaxial cable is disposed in the second chamber and electrically connected to the second substrate and the third plate.

The present invention utilizes a design of a grounding part having double ground terminals to change a current distribution of the antenna. Accordingly, the antenna will have a bandwidth thereof increased as the current distribution changes. Therefore, compared with conventional art, the mobile apparatus of the present invention may increase the bandwidth of the antenna without requiring adjustment of a height of the antenna, so as to help a realization of models of thinness.

In order to make the aforementioned and other features and advantages of the present invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1A:
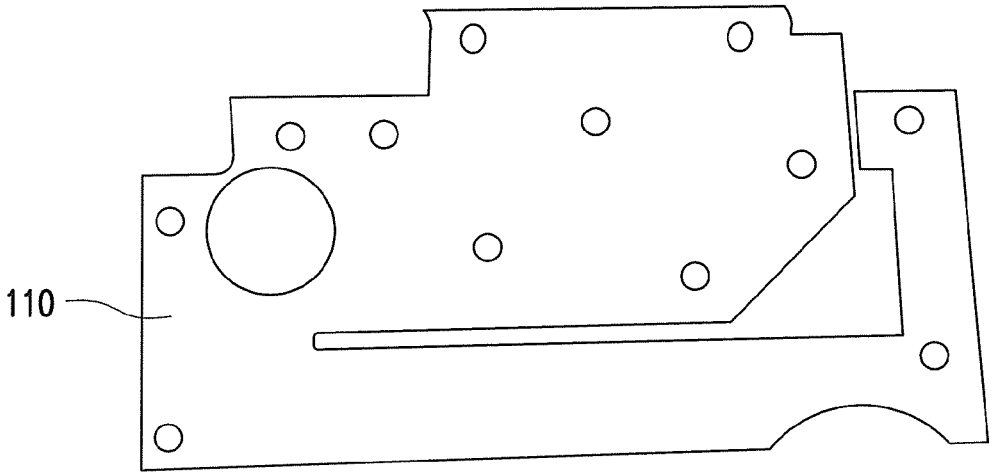
FIG. 1A (PRIOR ART)
FIG. 1A is a schematic diagram showing a top view of a conventional planar inverted F antenna.
Figure 1B:
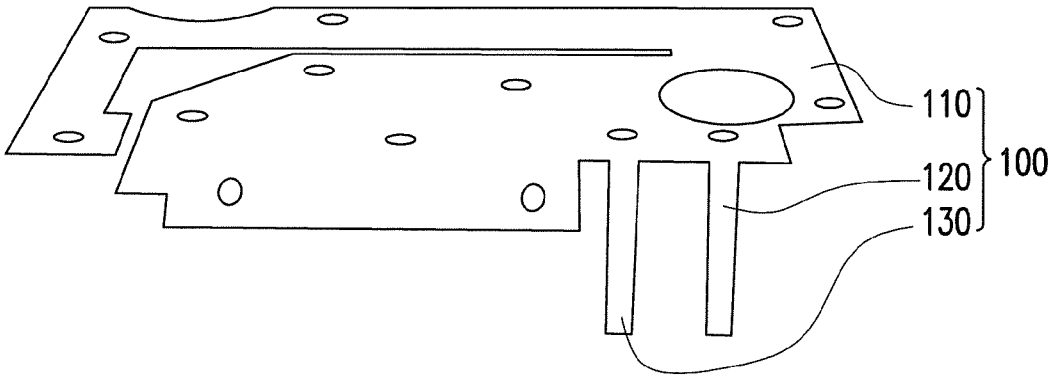
FIG. 1B (PRIOR ART)
FIG. 1B is a schematic diagram showing a side view of a conventional planar inverted F antenna.
Figure 2A:
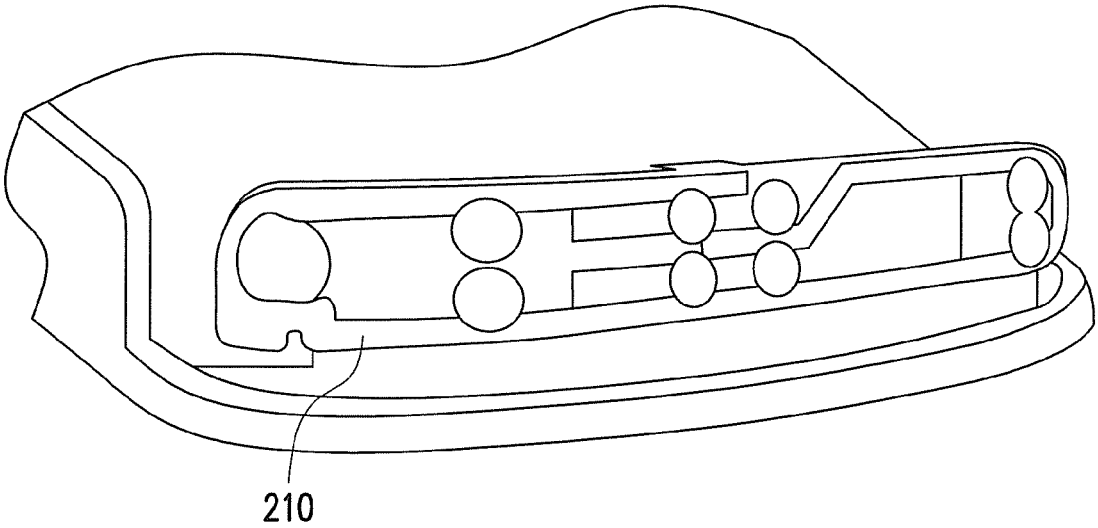
FIG. 2A (PRIOR ART)
FIG. 2A is a schematic diagram showing a side view of a monopole antenna.
Figure 2B:
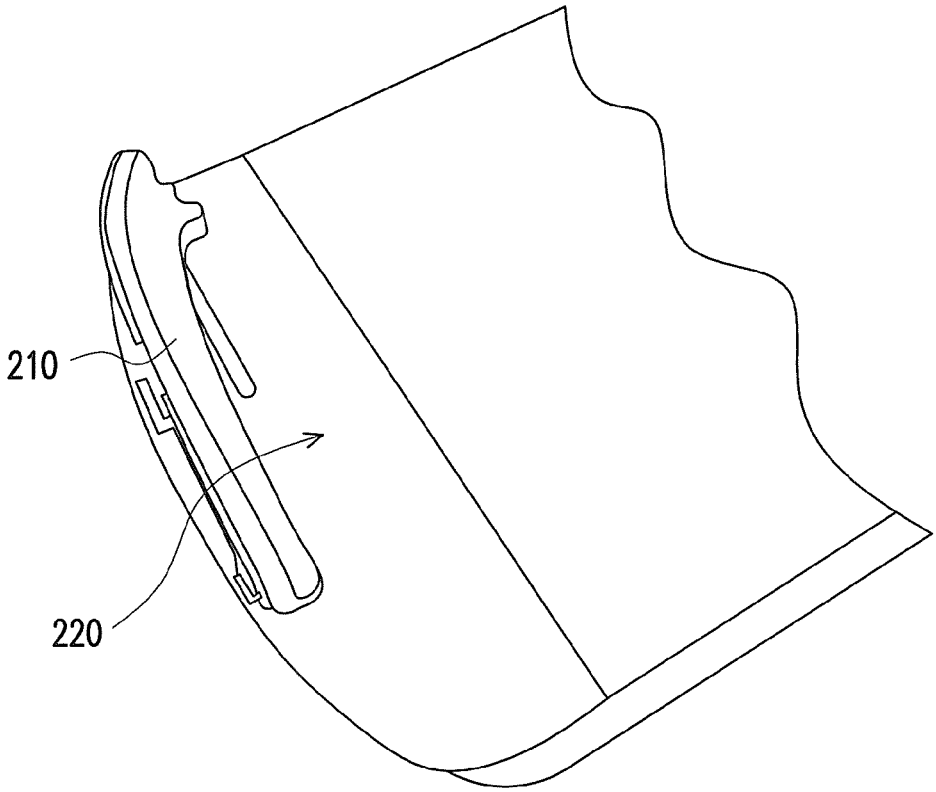
FIG. 2B (PRIOR ART)
FIG. 2B is a schematic diagram showing a top view of a monopole antenna.
Figure 3A:
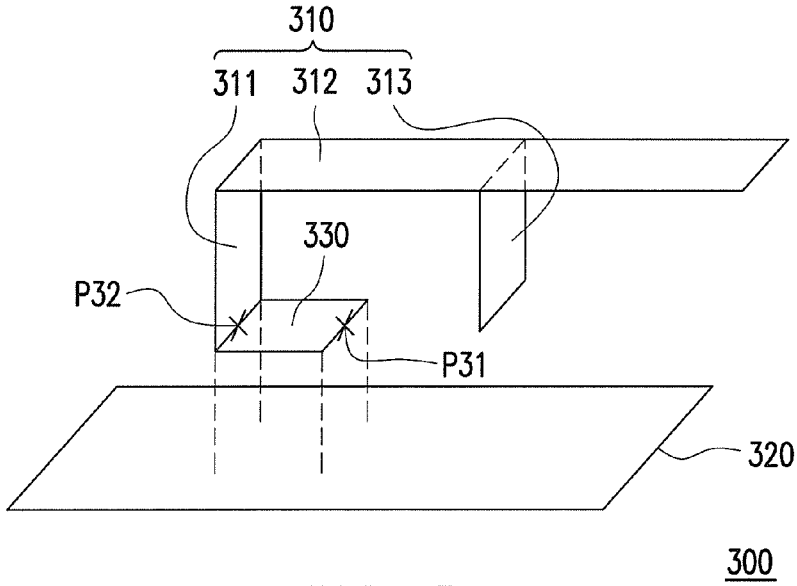
FIG. 3A is a schematic diagram showing a structure of a mobile apparatus according to an embodiment of the present invention.

FIG. 3A is a schematic diagram showing a structure of a mobile apparatus according to an embodiment of the present invention. Referring to 3A, a mobile apparatus 300 includes an antenna 310 and a ground plane 320. The antenna 310 includes a grounding part 311, a feeding part 313, and a body part 312. The grounding part 311, the feeding part 313, and the body part 312 of the antenna 310 are electrically connected to each other herein, and the grounding part 311 is electrically connected to the ground plane 320. In addition, the body part 312 is used to transmit or receive a RF signal, and the feeding part 313 is used to deliver the transmitted and received RF signal by the antenna 310.

Further, the grounding part 311 may include a conductive element 330, and the grounding part 311 includes a first ground terminal P31 and a second ground terminal P32. Wherein, the conductive element 330 extends inward from the second ground terminal P32 of the grounding part 311 such that the body part 312 and the conductive element 330 are at least partially overlapped on a vertical plane of projection. The first ground terminal P31 is disposed on the other terminal of the conductive element 330 and connects the conductive element 330 to the ground plane 320. Therefore, for the grounding part 311, the conductive element 330 provides the grounding part 311 with different current paths formed by the first ground terminal P31 and the second ground terminal P32 respectively connected to the ground plane 320.

It is to be noted that, a distance between the first ground terminal P31 and the second ground terminal P32 is associated with a wavelength ($\lambda$) of the RF signal transmitted and received by the antenna 310 under a resonance frequency. A ratio between the distance and the wavelength ($\lambda$) of the RF signals is within a predetermined range. In practical operation, two ground terminals may be very close to each other. However, if there is a distance between the two ground terminals, the maximum of the relative distance is in accordance with designs of a hardware structure. In the present embodiment, the relative distance between the two ground terminals is around $\lambda/64$ to $\lambda/4$, and the best mode is at $\lambda/8$ according to estimation of experimental results and effectiveness. In addition, a current path to ground provided by the ground terminal P32 may result in a change of a current distribution in the antenna 310 and further help increase an impedance match of the body part of the antenna 310.

Figure 3B:
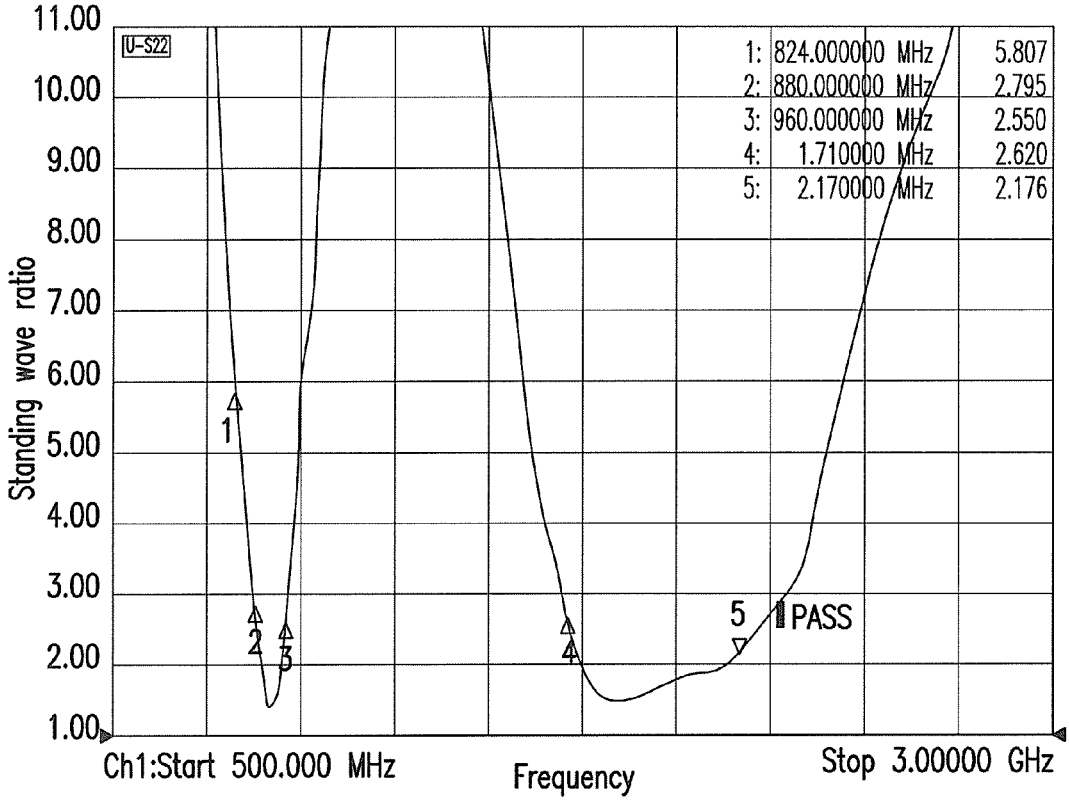
FIG. 3B is a voltage standing wave ratio chart of an antenna having double ground terminals according to an embodiment of the present invention.

In other words, the conductive element 330 illustrated by the present embodiment may be used to increase the impedance match of the body part of the antenna 310 so as to result in a lower reflection coefficient value and a lower voltage standing wave ratio (VSWR). For example, FIG. 3B is a voltage standing wave ratio diagram of an antenna having double ground terminals according to an embodiment of the present invention. As shown in FIG. 3B, an example of an antenna operating in a multi-band is taken for illustration. The operating band of the antenna may be respectively adjusted to 800 MHz~960 MHz and 1710 MHz~2170 MHz as the reflection coefficient decreases herein. This also means that the antenna 310 with the two ground terminals may have the bandwidth increased via the conductive element 330. Therefore, the present embodiment is able to increase the bandwidth of the antenna 310 without adjusting a height of the antenna 310. Accordingly, the mobile apparatus of the present embodiment will help a realization of models of thinness.

In a practical architecture, the antenna 310 and the conductive element 330 may be integrally formed. Besides, the antenna 310 may be a planar inverted F antenna and operated in a single band or a multi-band. Moreover, the mobile apparatus 300 may be a personal digital assistant phone, a smart phone, a satellite navigation device or a personal digital assistant. In order to make one having the ordinary skills in the art understand more about an allocation relationship of the antenna 310 and the ground plane 320 in the mobile apparatus 300, a practical architecture will be further described as the following.

Figure 4A:
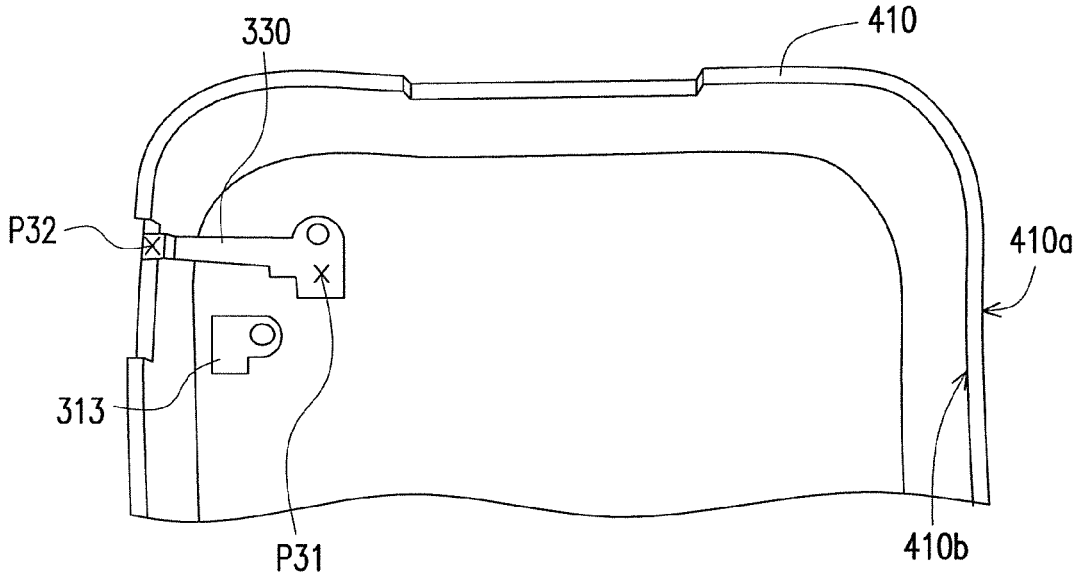
FIG. 4A to FIG. 4C are respectively a schematic diagram showing a partial structure of a mobile apparatus according to an embodiment of the present invention.
Figure 4B:
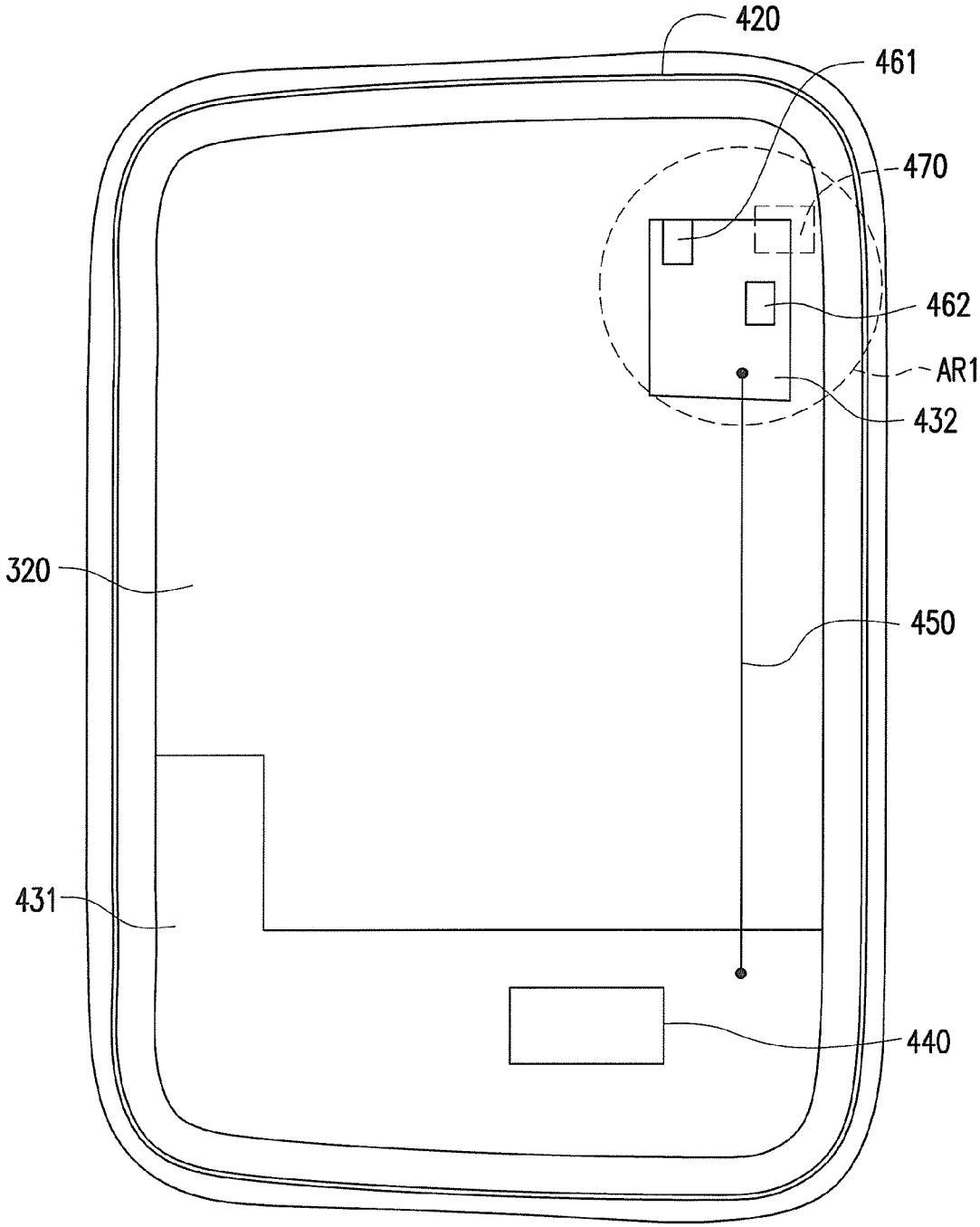
Figure 4C:
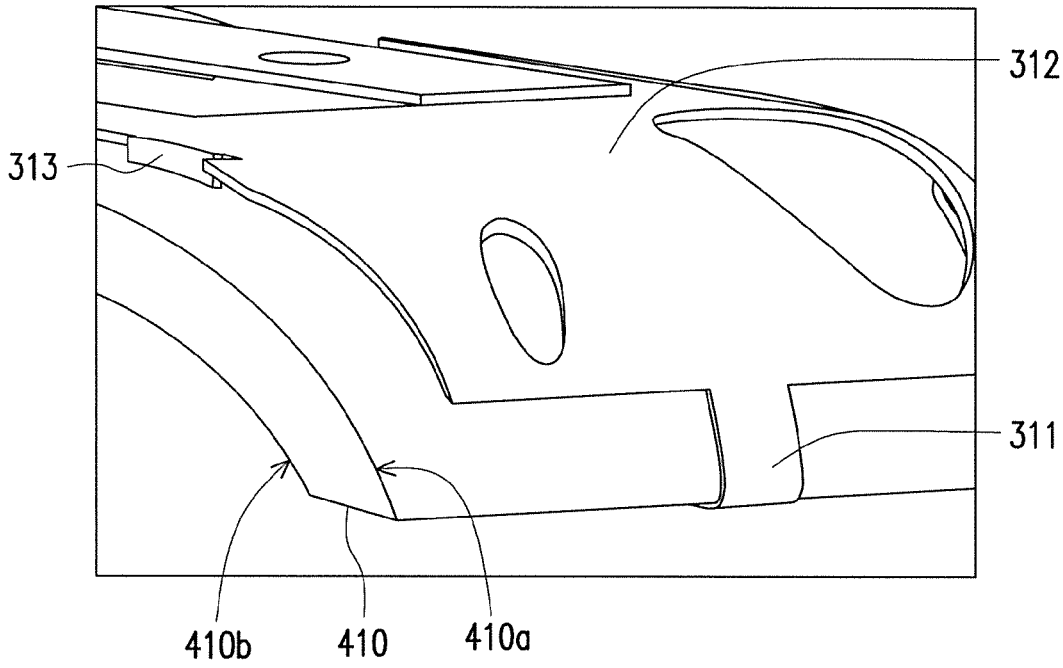

FIG. 4A to FIG. 4C are respectively a schematic diagram showing a partial structure of a mobile apparatus according to an embodiment of the present invention. Referring to FIG. 4A to FIG. 4C, the mobile apparatus further includes a housing 410, a housing 420, a substrate 431, a substrate 432, a transceiver circuit 440, a coaxial cable 450, a elastic element 461, a elastic element 462, and a conductive gasket 470, wherein the housing 410 is usually a component in the mobile apparatus 300 and may be a carrier of the antenna 310, and the housing 420 is usually a body of the mobile apparatus 300, further plus a back cover (not shown), assembled in a sandwich lamination way (the back cover→the housing 410→the housing 420), and FIG. 4A is a schematic diagram exemplarily showing a partial structure inside the housing 410, and FIG. 4C is a schematic diagram exemplarily showing a partial structure outside the housing 410. Referring to FIG. 3A, FIG. 4A and FIG. 4C, the feeding part 313, the grounding part 311 and the body part 312 of the antenna 310 are respectively disposed on an internal surface 410*b* and an external surface 410*a* of the housing 410. The grounding part 311 extends from the external surface 410*a* of the housing 410 to the internal surface 410*b* of the housing 410 herein such that the first ground terminal P31 and the second ground terminal P32 are disposed on the internal surface 410*b* of the housing 410. Similarly, the feeding part 313 passes through the housing 410 for extending to the internal surface 410*b* of the housing 410. The body part 312 is fixed on the external surface 410*a* of the housing 410 so as to make the antenna cover surfaces of the housing 410.

Referring to FIG. 4B, the substrate 431 is disposed on the ground plane 320, and the conductive gasket 470 is disposed on a neighboring location of a corner of the substrate 432. However, there is a distance between the substrate 432 and the conductive gasket 470, so the substrate 432 and the conductive gasket 470 are not in contact, and two substrates are electrically connected to each other via the coaxial cable 450. The transceiver circuit 440 is disposed on the substrate 431. A portion of a projection area of the substrate 432 partially covers the conductive gasket 470 herein. The elastic element 461 and the elastic element 462 are assembled on the substrate 432. To be specific, an area AR1 is a circuit area corresponding to the antenna 310 when the housing 410 and the housing 420 are overlapped, and the FIG. 5 is a magnified schematic diagram showing the area AR1.

Figure 5:
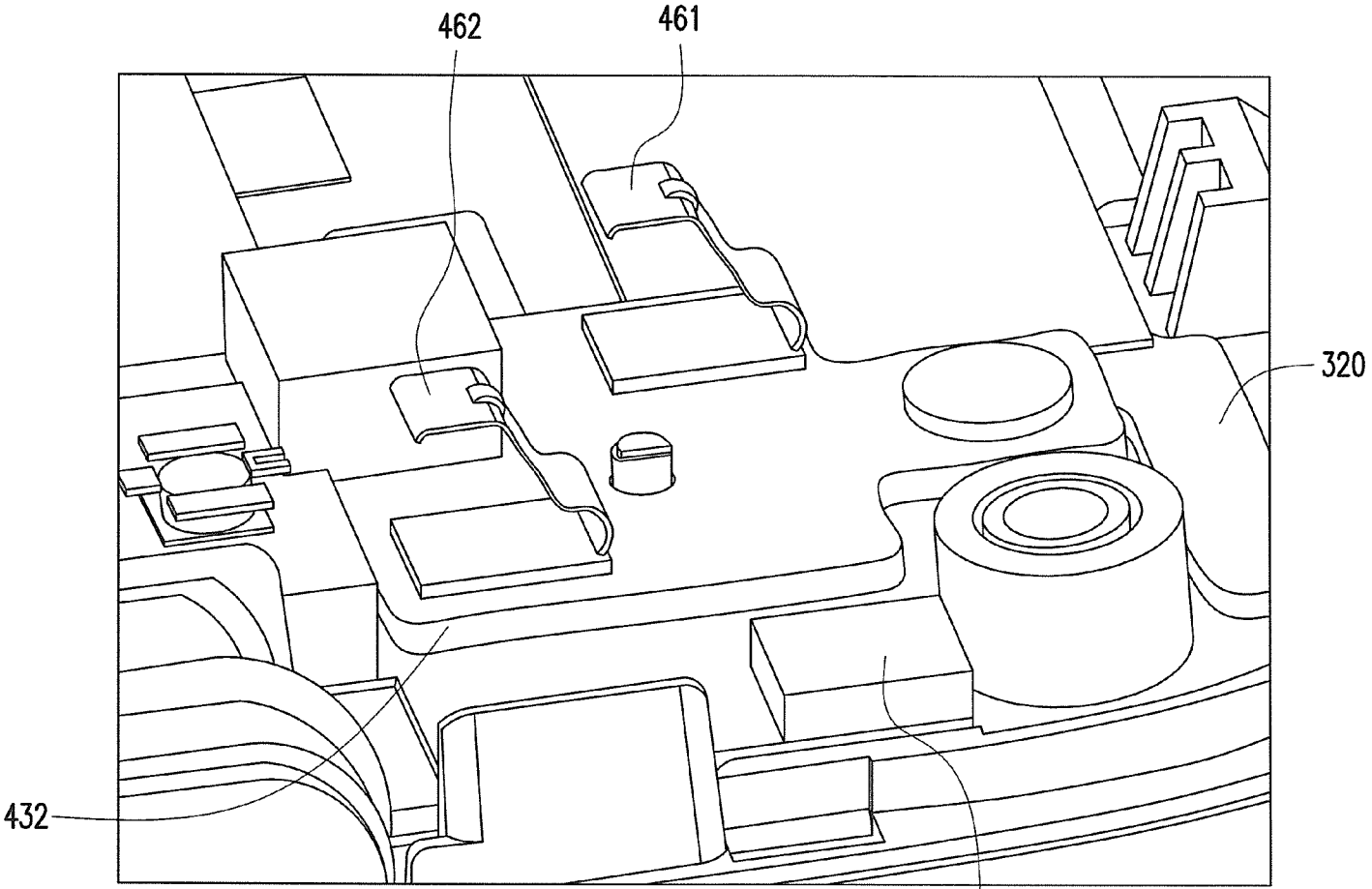
FIG. 5 is a magnified schematic diagram of an area AR1 of FIG. 4B.

Referring to FIG. 5, the substrate 431 is disposed on the ground plane 320, and the conductive gasket 470 is partially attached to the ground plane 320. Accordingly, when assembly is completed, the elastic element 461 on the substrate 432 is floating in touch with the first ground terminal P31 for producing an electrical connection, the elastic element 461 is further electrically connected to the ground plane 320 through the coaxial cable 450 and the substrate 431, and the elastic element 461 may not be wedged to the first ground terminal P31. On the other hand, the second ground terminal P32 is in touch with the conductive gasket 470 and electrically connected to the ground plane 320 through the conductive gasket 470. In addition, the elastic element 462 is floating in touch with the feeding part 313 and delivers the RF signals transmitted or received to the transceiver circuit 440 through the coaxial cable 450 and other internal circuits, and later processed by necessary signal processing. Herein, the elastic element 462 is in touch with the feeding part 313 for producing an electrical connection. In fact, the elastic element 462 may not be wedged to the feeding part 313.

It is to be noted that the one having ordinary skills in the art may adjust the way in which the elastic element 461 and the conductive gasket 470 are electrically connected to the ground plane 320 according to requirements of designs. For example, the one having ordinary skills in the art may remove the substrate 432 and the conductive gasket 470 in FIG. 4B, and allocate the elastic element 461 and the elastic element 462 on the ground plane 320. Accordingly, the one having ordinary skills in the art may make the elastic element 461 electrically connected to the ground plane 320 by directly adjusting an arrangement of the substrate 431 on the ground plane 320, and maintain the elastic element 462 just electrically connected to the transceiver circuit 440. Alternatively, the substrate 432 may also be in touch with the conductive gasket 470, so when the elastic element 461 is floating in touch with the first ground terminal P31 and the second ground terminal P32 contacts with the conductive gasket 470, the first ground terminal P31 and the second ground terminal P32 both may be connected to the ground plane 320 via the conductive gasket 470, further changing the current distribution of the ground path through the coaxial cable 450 and also consequently increasing the bandwidth of the antenna 310. In addition, the substrate 431 and the substrate 432 in FIG. 4B may be printed circuit board.

Figure 6:
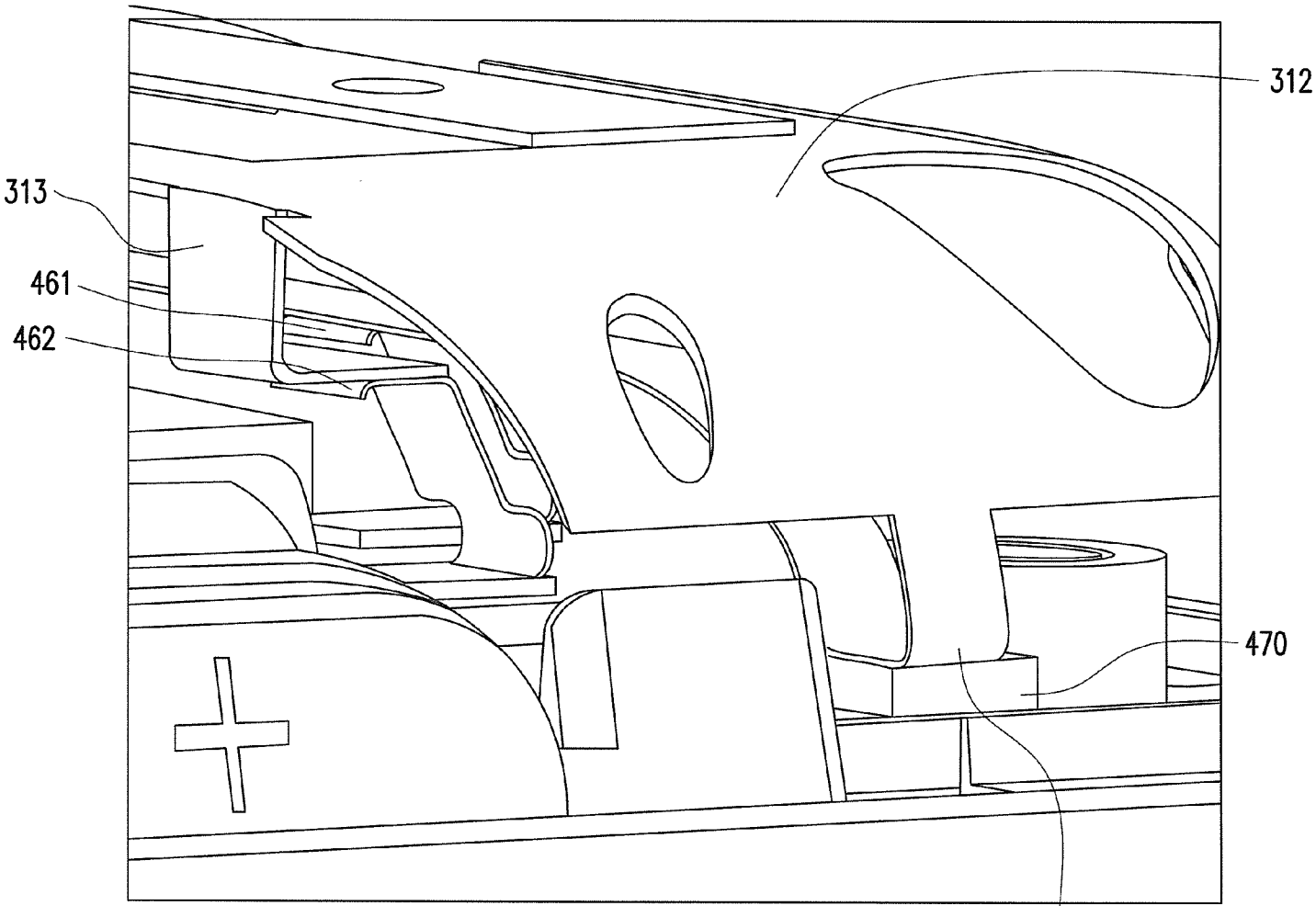
FIG. 6 is a partial magnified schematic diagram showing a housing 410 and a housing 420 wedged together.

It is to be noted that, the housing 410 of FIG. 4A and the housing 420 of FIG. 4B may be wedged to each other correspondingly to form a chamber. In addition, the substrate 431 and the substrate 432 are disposed inside the chamber, a portion of the feeding part 313 and a portion of the grounding part 311 are disposed inside the chamber, and the body part 312 covers on the housing 410 outside the chamber. To be specific, FIG. 6 is a partial magnified schematic diagram showing a housing 410 and a housing 420 wedged together. Wherein, FIG. 6 shows a transparent view of the housing 410 in FIG. 4A but only leaving the part for the antenna 310.

Referring to all FIG. 4A, FIG. 4B, and FIG. 6. The elastic element 461 and the elastic element 462 of FIG. 4B are respectively corresponding to the first ground terminal P31 and the feeding part 313 of FIG. 4A herein. In addition, the elastic element 461 and the elastic element 462 are respectively suitable floating in touch with the first ground terminal P31 of the grounding part 311 and the feeding part 313 of the antenna 310. Besides, the conductive gasket 470 is corresponding to the second ground terminal P32, and the conductive gasket 470 and the second ground terminal P32 are electrically connected. It is to be noted that the one having ordinary skills in the art may alter corresponding allocation locations of the feeding part 313 and the grounding part 311 in any way according to the requirements of the designs. Therefore, the relative locations of the elastic element 461, the elastic element 462, and the conductive gasket 470 of the present embodiment are not intended to limit the present invention.

In summary, the present invention provides an antenna grounding part having a double ground terminals design adapted for a mobile apparatus. Accordingly, the antenna generates different current distributions when transmitting and receiving the RF signal, and decreases the reflection coefficients and the voltage standing wave ratio of the antenna due to differences of the current distribution. Therefore, the mobile apparatus may have a spacing height between the antenna and the ground plane when setting the antenna so as to help a realization of models of thinness.

Although the present invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A mobile apparatus, comprising:

a first housing and a second housing, for forming a first chamber;

an antenna, receiving or transmitting a radio frequency (RF) signal and including:

a feeding part, passing through the first housing for extending to an internal surface of the first housing; and a grounding part, attached to an external surface and the internal surface of the first housing and having a first ground terminal and a second ground terminal disposed on the internal surface of the first housing; and a ground plane, electrically connected to the grounding part of the antenna through the first ground terminal and the second ground terminal.

2. The mobile apparatus as claimed in claim 1, wherein the antenna further comprising:

a body part, electrically connected to the grounding part and the feeding part, for receiving or transmitting the RF signal, wherein the body part is fixed on the external surface of the first housing, and the feeding part is electrically connected to a transceiver circuit.

3. The mobile apparatus as claimed in claim 2, wherein the grounding part comprises:

a conductive element, extending inward from the second ground terminal of the grounding part at one end of the conductive element to make the body part and the conductive element at least overlapped partially on a vertical plane of projection, wherein the first ground terminal is disposed on the other end of the conductive element, and the conductive element is electrically connected to the ground plane, and the conductive element is used to increase an impedance match of the body part of the antenna in the mobile apparatus.

4. The mobile apparatus as claimed in claim 3, wherein the antenna and the conductive element are integrally formed.

5. The mobile apparatus as claimed in claim 1, wherein a distance between the first ground terminal and the second ground terminal is 1/64 to 1/4 times of a wavelength of the RF signal.

6. The mobile apparatus as claimed in claim 1, further comprising:

a first elastic element, corresponding to the first ground terminal and suitable for electrically connected to the grounding part; and a second elastic element, corresponding to the feeding part and suitable for electrically connected to the feeding part.

7. The mobile apparatus as claimed in claim 6, further comprising:

a first substrate, disposed in the first chamber, and fixed on the second housing, wherein the ground plane is disposed on the second housing, and the first elastic element and the second elastic element are assembled on the first substrate; and a coaxial cable, disposed in the first chamber and electrically connected to the first substrate and the ground plane.

8. The mobile apparatus of claim 7, wherein the first substrate is a printed circuit board.

9. The mobile apparatus as claimed in claim 6, further comprising:

a first substrate, disposed in the first chamber and fixed in the second housing, wherein the ground plane is disposed on the second housing, and the first substrate is electrically connected to the ground plane;

a conductive gasket, partially attached to the ground plane;

a second substrate, disposed in the first chamber, wherein the conductive gasket is disposed on a neighboring location of a corner of the second substrate, but there is a spacing between the second substrate and the conductive gasket such that the second substrate and the conductive gasket are not in contact, and the second ground terminal is electrically connected to the ground plane via the conductive gasket, wherein the first elastic element and the second elastic element are assembled on the second substrate, and a portion of a projection plane of the second substrate partially covers the conductive gasket; and a coaxial cable, disposed in the first chamber and electrically connected to the first substrate and the second substrate.

10. The mobile apparatus as claimed in claim 9, wherein the first substrate and the second substrate are respectively a printed circuit board.

11. The mobile apparatus as claimed in claim 1, wherein the antenna is a planar inverted F antenna (PIFA).

12. The mobile apparatus as claimed in claim 1, wherein the antenna is operated in a single band or in a multi-band.

13. The mobile apparatus as claimed in claim 1, wherein the mobile apparatus is a personal digital assistant phone, a smart phone, a satellite navigation device or a personal digital assistant.

* * * * *